US005699819A

United States Patent [19]

Simons

[11] Patent Number: 5,699,819

[45] Date of Patent: Dec. 23, 1997

[54] REDUCED IMPACT CANE

[76] Inventor: Fred M. Simons, 23 Lighthouse Rd., Gay Head, Mass. 02535

[21] Appl. No.: 762,280

[22] Filed: Dec. 9, 1996

[51] Int. Cl.[6] ..... A45B 9/04

[52] U.S. Cl. ..... 135/82; 135/77

[58] Field of Search ..... 135/77, 82, 68, 135/65, 86, 67, 70

[56] References Cited

U.S. PATENT DOCUMENTS

| | | | |
|---|---|---|---|
| 1,406,453 | 2/1922 | Fanning | 135/82 |
| 1,568,423 | 1/1926 | Sifferlen | 135/65 X |
| 1,753,065 | 4/1930 | Payne | 135/82 |
| 1,761,502 | 6/1930 | Sullivan | 135/82 |
| 2,397,499 | 4/1946 | McGowan | 135/82 |
| 2,398,534 | 4/1946 | Klausnitzer et al. | 135/82 |
| 2,414,758 | 1/1947 | Moss | 135/82 |
| 2,802,479 | 8/1957 | Hickman | 135/65 |
| 2,888,022 | 5/1959 | Fanning | 135/82 |
| 4,630,626 | 12/1986 | Urban | 135/84 |
| 4,958,651 | 9/1990 | Najm | 135/82 |

FOREIGN PATENT DOCUMENTS

| | | | |
|---|---|---|---|
| 371291 | 1/1907 | France | 135/82 |
| 5473 | 3/1894 | United Kingdom | 135/82 |

*Primary Examiner*—Lanna Mai

[57] ABSTRACT

A new Reduced Impact Cane for absorbing the impact of a cane striking against an unyielding surface. The inventive device includes a cane having a end, a spring connector, a connecting sleeve disposed around the cane end and spring connector, a collar disposed around the lower end of the spring connector, a rubber tip disposed around the collar, and a spring interposed between the lower end of the spring connector and the rubber tip.

10 Claims, 3 Drawing Sheets

REDUCED IMPACT CANE

BACKGROUND OF THE INVENTION

1. Field of the Invention

The present invention relates to walking cane impact cushioning devices and more particularly pertains to a new Reduced Impact Cane Attachment for absorbing the impact of a cane striking against an unyielding surface.

2. Description of the Prior Art

The use of walking cane impact cushioning devices is known in the prior art. More specifically, walking cane impact cushioning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art walking cane impact cushioning devices include U.S. Pat. No. 4,958,651; U.S. Pat. No. 4,062,372; U.S. Pat. No. Des. 324,946; U.S. Pat. No. 3,987,807; U.S. Pat. No. 5,282,805 and U.S. Pat. No. 4,883,493.

While these devices fulfill their respective, particular objectives and requirements, the aforementioned patents do not disclose a new Reduced Impact Cane Attachment. The inventive device includes a cane having a end, a spring connector, a connecting sleeve disposed around the cane end and spring connector, a collar disposed around the lower end of the spring connector, a rubber tip disposed around the collar, and a spring interposed between the lower end of the spring connector and the rubber tip.

In these respects, the Reduced Impact Cane Attachment according to the present invention substantially departs from the conventional concepts and designs of the prior art, and in so doing provides an apparatus primarily developed for the purpose of absorbing the impact of a cane striking against an unyielding surface.

SUMMARY OF THE INVENTION

In view of the foregoing disadvantages inherent in the known types of walking cane impact cushioning devices now present in the prior art, the present invention provides a new Reduced Impact Cane Attachment construction wherein the same can be utilized for absorbing the impact of a cane striking against an unyielding surface.

The general purpose of the present invention, which will be described subsequently in greater detail, is to provide a new Reduced Impact Cane Attachment apparatus and method which has many of the advantages of the walking cane impact cushioning devices mentioned heretofore and many novel features that result in a new Reduced Impact Cane Attachment which is not anticipated, rendered obvious, suggested, or even implied by any of the prior art walking cane impact cushioning devices, either alone or in any combination thereof.

To attain this, the present invention generally comprises a cane having a end, a spring connector, a connecting sleeve disposed around the cane end and spring connector, a collar disposed around the lower end of the spring connector, a rubber tip disposed around the collar, and a spring interposed between the lower end of the spring connector and the rubber tip.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Reduced Impact Cane Attachment apparatus and method which has many of the advantages of the walking cane impact cushioning devices mentioned heretofore and many novel features that result in a new Reduced Impact Cane Attachment which is not anticipated, rendered obvious, suggested, or even implied by any of the prior art walking cane impact cushioning devices, either alone or in any combination thereof.

It is another object of the present invention to provide a new Reduced Impact Cane Attachment which may be easily and efficiently manufactured and marketed.

It is a further object of the present invention to provide a new Reduced Impact Cane Attachment which is of a durable and reliable construction.

An even further object of the present invention is to provide a new Reduced Impact Cane Attachment which is susceptible of a low cost of manufacture with regard to both materials and labor, and which accordingly is then susceptible of low prices of sale to the consuming public, thereby making such Reduced Impact Cane Attachment economically available to the buying public.

Still yet another object of the present invention is to provide a new Reduced Impact Cane Attachment which provides in the apparatuses and methods of the prior art some of the advantages thereof, while simultaneously overcoming some of the disadvantages normally associated therewith.

Still another object of the present invention is to provide a new Reduced Impact Cane Attachment for absorbing the impact of a cane striking against an unyielding surface.

Yet another object of the present invention is to provide a new Reduced Impact Cane Attachment which includes a cane having a end, a spring connector, a connecting sleeve disposed around the cane end and spring connector, a collar disposed around the lower end of the spring connector, a rubber tip disposed around the collar, and a spring interposed between the lower end of the spring connector and the rubber tip.

Still yet another object of the present invention is to provide a new Reduced Impact Cane Attachment that causes less impact stress and strain on the user's body.

Even still another object of the present invention is to provide a new Reduced Impact Cane Attachment that helps provide greater stability and less stress to the user when rising from a seated position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
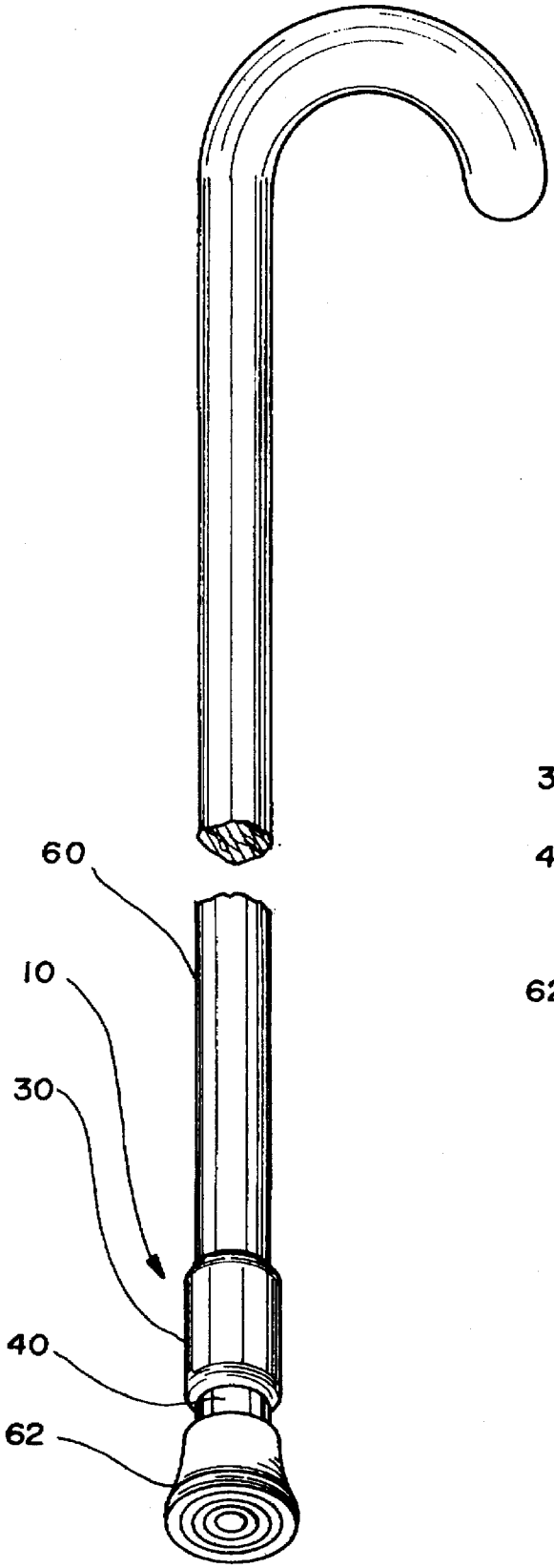
FIG. 1 is perspective view of a new Reduced Impact Cane Attachment with a walking cane according to the present invention.
Figure 2:
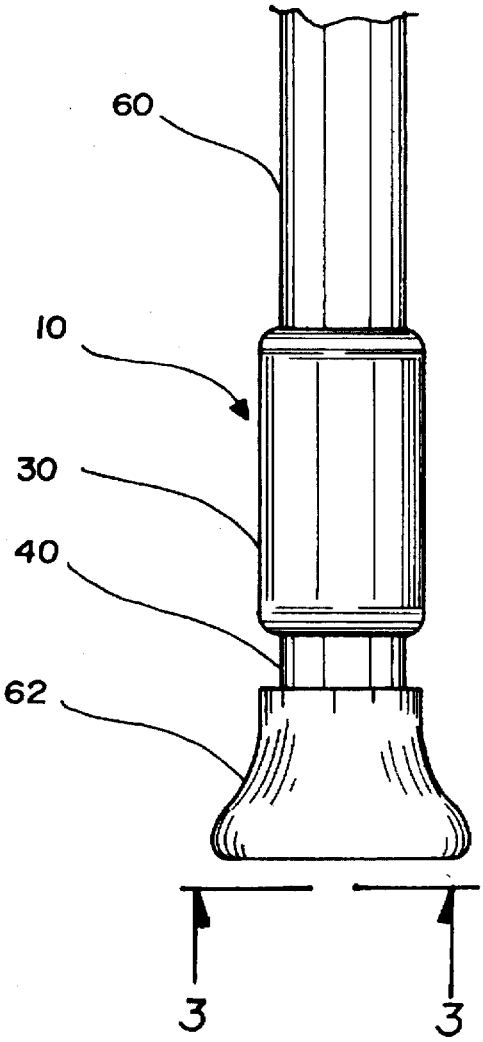
FIG. 2 is a side elevation view of the Reduced Impact Cane Attachment.
Figure 3:
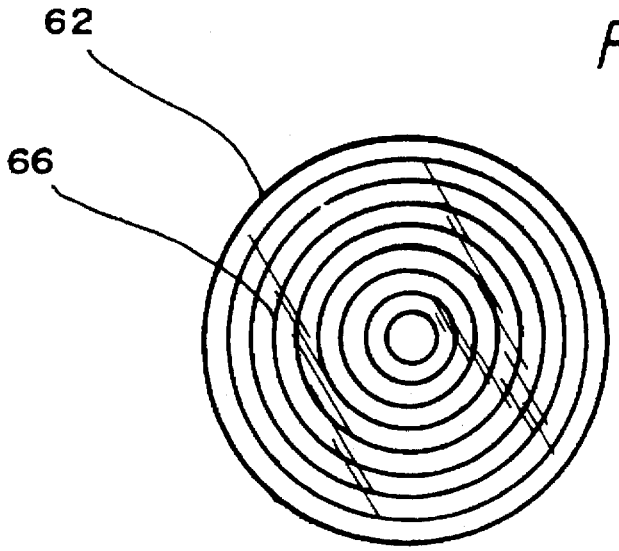
FIG. 3 is a bottom view of the rubber tip showing traction rings taken along Line 3—3 of FIG. 2.
Figure 4:
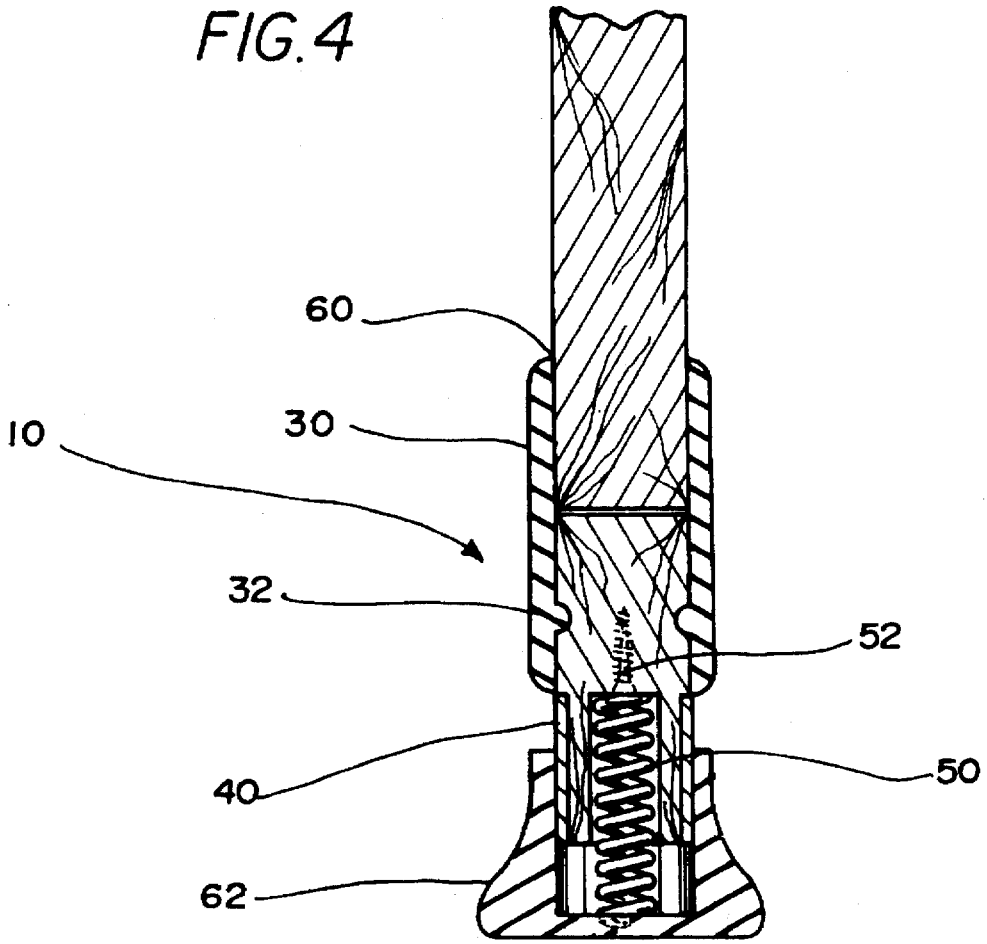
FIG. 4 is a cross sectional side view of the Reduced Impact Cane Attachment.
Figure 5:
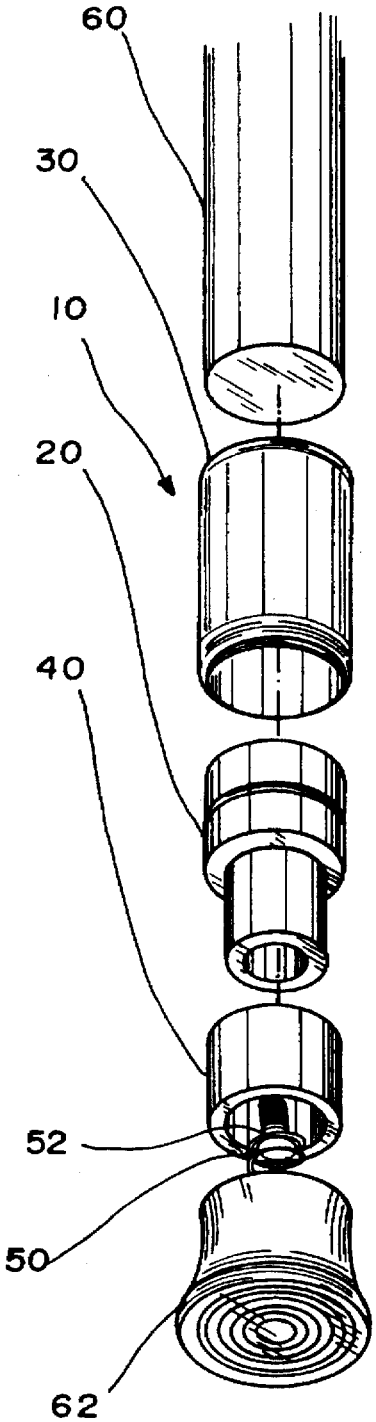
FIG. 5 is an exploded perspective view of the Reduced Impact Cane Attachment.

With reference now to the drawings, and in particular to FIGS. 1 through 6 thereof, a new Reduced Impact Cane Attachment embodying the principles and concepts of the present invention and generally designated by the reference numeral 10 will be described.

More specifically, it will be noted that the Reduced Impact Cane Attachment 10 comprises a cane 60, a spring connector 20, a connecting sleeve 30, a collar 40, a spring 50 and a rubber tip 62.

Figure 6:
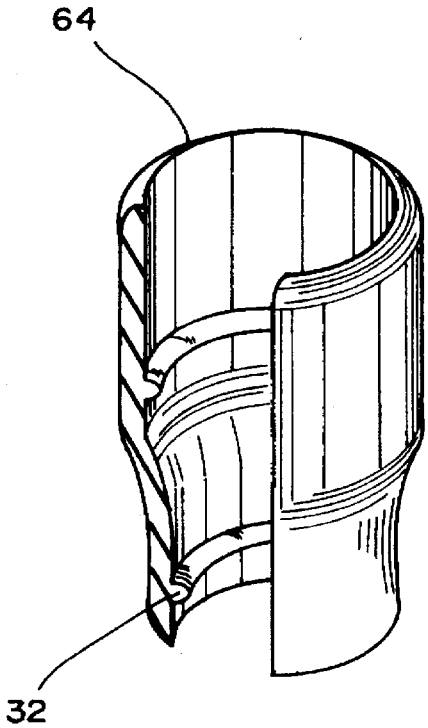
FIG. 6 is a partial cross sectional perspective view of the connecting sleeve for bigger sized cane stock.

As best illustrated in FIGS. 1 through 6, it can be shown that the spring connector 20 is preferably made of a hard wood and two inches long. The upper end of the spring connector 20 is connected to the end of a standard stock diameter cane 60 by the connecting sleeve 30. The connecting sleeve 30 is made of rubber and is frictionally fit to the cane 60 and the spring connector 20. The connecting sleeve 30 also includes a ridge 32 on its inner diameter and there is a corresponding groove in the upper end of the spring connector 20 to accept the ridge 32. This feature is to keep the connecting sleeve 30 in place over the cane 60 and the spring connector when using the Reduced Impact Cane Attachment 10. A rubber adapter connecting sleeve 64 having a larger upper end diameter can be used in place of the connecting sleeve 30 for larger stock diameter canes. With reference to FIG. 6, the connecting sleeve 30, 64 may optionally include an other ridge on its inner diameter spaced apart from the first ridge 32. This second ridge may be accepted by a corresponding groove (not shown) on the end of the cane 60 to help hold the connecting sleeve 30, 64 on the cane 60.

A collar 40 preferably made of steel is force fit around the lower end of the spring connector 30. The upper end of rubber tip 62 has a rim that is fitted snugly around the collar 40 in such a way to allow the rubber tip 62 to slide up and down on the collar 40 while using the Reduced Impact Cane Attachment 10.

The spring 50 is interposed between the lower end of the spring connector 20 and the rubber tip 62 so that a space is formed between the spring connector 20 and the rubber tip 62. This space allows the rubber tip 62 to slide up and down on the collar 40 while using the Reduced Impact Cane Attachment 10.

The lower end of the spring connector 30 has a longitudinally drilled hole that accepts the spring 50. The upper end of the spring 50 in the drilled hole is fastened to the spring connector 20 by a screw 32. The lower end of the spring 50 is fastened to the rubber tip 62 to prevent the rubber tip from sliding off the collar 40 when in use.

In use, the user should first find the proper length cane 60. While standing, the user should hold the cane 60 without a rubber tip 62 at his or her side and parallel to the leg. The end of the cane 60 should just touch the ground. Then, two inches should be cut off the bottom end of the cane 60 and the connecting sleeve 30 fitted over the cane end to attach the Reduced Impact Cane Attachment 10. When a cane 60 with the Reduced Impact Cane Attachment 10 strikes the ground, the spring 50 is compressed and the rubber tip 62 slides upwardly on the collar. Thus, the spring 50 and space arrangement of the spring connector 20 and rubber tip 62 act as a shock absorber to cushion the impact of the cane 60 striking against an unyielding surface. The rubber tip 62 can also include traction rings 66 on its bottom side to help prevent the rubber tip 62 from slipping on the ground when the Reduced Impact Cane Attachment 10 is in use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reduced impact cane attachment, comprising:

a cane having an end;

a tip; and a reduced impact means including:

a spring connector having first end and a second end;

a connecting sleeve having a first end and a second end, said connecting sleeve first end being disposed around said cane end, said connecting sleeve second end being disposed around said first end of said spring connector;

a collar being disposed around said second end of said spring connector, said tip being disposed around said collar;

a spring being accepted by second end of said spring connector and said spring being coupled to said rubber tip;

wherein said connecting sleeve second end includes a ridge, said ridge being accepted by said first end of spring connector;

wherein said connecting sleeve first end includes an other ridge, said other ridge being accepted by said cane end.

2. A reduced impact cane attachment, comprising:

a spring connector having first end and a second end;

a connecting sleeve having a first end and a second end, said connecting sleeve second end being disposed around said first end of said spring connector;

a collar disposed around said second end of said spring connector;

a tip having a first end, said first end of said tip being disposed around said collar;

a spring being accepted by second end of said spring connector and said spring being coupled to said tip; and wherein said connecting sleeve second end includes a ridge, said ridge being accepted by said first end of spring connector.

3. The reduced impact cane attachment of claim 2, wherein said first end of said first end of said connecting sleeve is adapted to accept a cane.

4. The reduced impact cane attachment of claim 3, further comprising a cane having an end, said first end of said connecting sleeve being disposed around said end of said cane.

5. The reduced impact cane attachment of claim 2, wherein said connecting sleeve is frictionally coupled to said first end of said spring connector.

6. The reduced impact cane attachment of claim 2, wherein said spring connector is made of wood and said spring is coupled to said spring connector by means of a screw.

7. The reduced impact cane of claim 2, wherein said collar is made of metal.

8. The reduced impact cane of claim 2, wherein said spring is interposed between said second end of said spring connector and said first end of said tip.

9. The reduced impact cane attachment of claim 2, wherein said connecting sleeve first end includes an other ridge, said other ridge being accepted by said cane end.

10. A reduced impact cane, comprising:

a cane having an end;

a spring connector being made of wood and having first end and a second end;

a connecting sleeve being made of rubber and having a first end accepting said cane and a second end including a ridge, said first end of said connecting sleeve being disposed around said end of said cane, said second end of said connecting sleeve disposed around said first end of said spring connector, said ridge being accepted by said first end of spring connector, and said connecting sleeve being frictionally coupled to said first end of said spring connector and said end of said cane;

a collar disposed around said second end of said spring connector;

a rubber tip having a first end, said first end of said rubber tip being disposed around said collar;

a spring interposed between said second end of said spring connector and said first end of said rubber tip, said spring being accepted by second end of said spring connector, said spring being coupled to said spring connector by means of a screw, and said spring being coupled to said rubber tip; and said collar is made of steel.

* * * * *